United States Patent [19]

Perrine

[11] 4,183,282

[45] Jan. 15, 1980

[54] TOGGLE ACTUATING, SHELL LOADING AND EJECTING APPARATUS FOR HAND HELD GUNS

[76] Inventor: Walter E. Perrine, P.O. Box 621, Elko, Nev. 89801

[21] Appl. No.: 829,796

[22] Filed: Sep. 1, 1977

[51] Int. Cl.[2] ..... F41D 3/02

[52] U.S. Cl. ..... 89/189; 89/1 K; 89/198

[58] Field of Search ..... 42/16; 89/1 K, 189, 89/198

[56] References Cited

U.S. PATENT DOCUMENTS

| | | | |
|---|---|---|---|
| 960,825 | 6/1910 | Colleoni | 89/189 |
| 2,401,903 | 6/1946 | Browning | 42/16 |
| 3,661,049 | 5/1972 | Perrine | 89/189 |

FOREIGN PATENT DOCUMENTS

| | | | |
|---|---|---|---|
| 9758 | 2/1901 | Norway | 89/198 |
| 579278 | 7/1946 | United Kingdom | 89/198 |

*Primary Examiner*—Stephen C. Bentley
*Attorney, Agent, or Firm*—Warren F. B. Lindsley

[57] ABSTRACT

A toggle action pistol employing improved bolt design and movement control to reduce recoil, facilitate loading and ejecting of the shells and to substantially reduce misfiring of the weapon.

7 Claims, 21 Drawing Figures

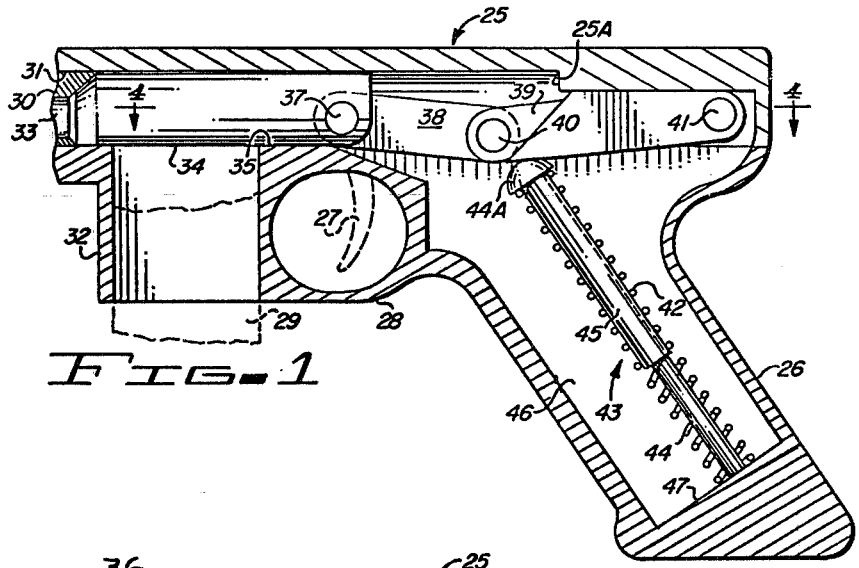
FIG-1
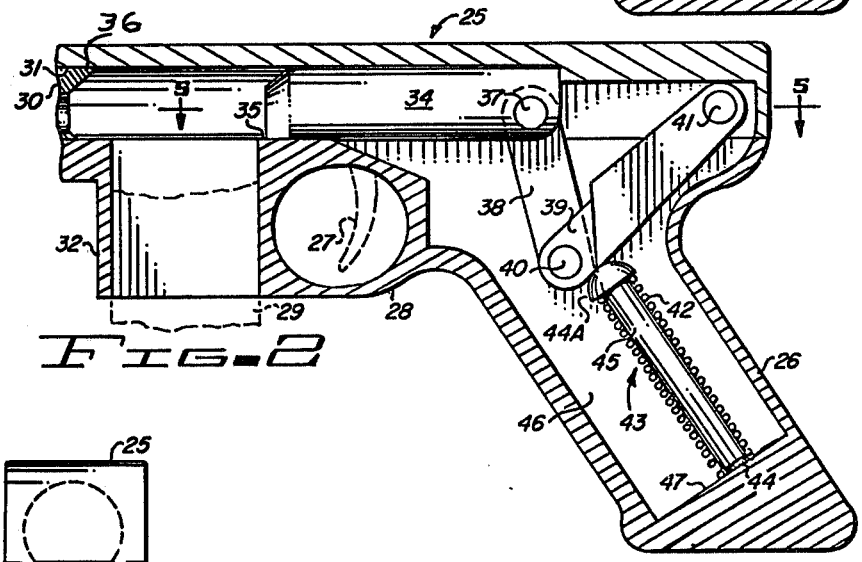
FIG-2
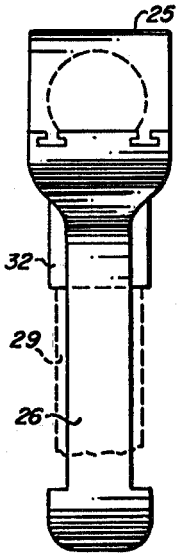
FIG-3
FIG-4
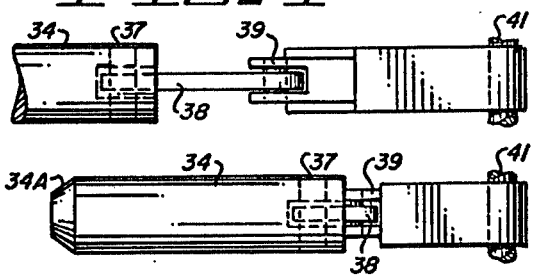
FIG-5

TOGGLE ACTUATING, SHELL LOADING AND EJECTING APPARATUS FOR HAND HELD GUNS

BACKGROUND OF THE INVENTION

This invention pertains to toggle action weapons, and is particularly directed to means for causing a blow back toggle to recede into the handle of the pistol by gas pressure generated at the time of firing and employs a novel bolt configuration and control means therefor for absorbing recoil forces.

1. Field of the Invention

This invention is particularly directed to toggle action weapons such as pistols wherein a bolt extending toggle tripped from a locked position by gas pressure from the gun barrel when the gun is fired is configured to reduce the weight of the moving parts of the weapon located above the hands of the user thereby substantially reducing recoil of the weapon.

2. Description of the Prior Art

Heretofore, the majority of all toggle actuated weapons of this class have been recoil operated causing their toggles to recede into the handle of the pistol when fired to offset the effects of firing recoil and are biased toward their locked position by a spring means bearing in a given area on the toggle.

Under-center and over-center toggles in toggle action weapons work efficiently and lock permanently when properly designed and weapons such as pistols can be designed to use high chamber pressure ammunition, i.e., heavy charged ammunition, effectively in short barrled guns if the toggles are biased properly in a given manner.

Since the largest contributor to the forces of recoil in toggle action weapons are the moving parts of the weapon arranged above the hands of the user, it is necessary to reduce this weight if recoil of the weapon is to be further reduced and more effectively controlled. Accordingly, the bolt design of the prior art and its spring control means arranged above the trigger hand of the user must be modified or changed.

SUMMARY OF THE INVENTION

In accordance with the invention claimed, a new and improved toggle mechanism employing a novel bolt configuration and controls therefor is disclosed which can be used effectively to absorb the effects of the shell explosive forces, whether using an under-center toggle, over-center toggle, or any variation thereof.

The new and improved weapons employing such a toggle mechanism utilize gun barrel pressure to drive their bolts and associated biased toggles from their locked position to their tripped position. At the time this happens, the bullet has left the barrel of the gun and the residual pressure in the gun breaks or collapses the toggle and causes the toggle to move to its fully retracted position in the handle of the weapon. Recoil springs in the gun reacting on the toggle arms return the toggle to a predetermined locked position.

To facilitate loading and ejecting of the shells and to reduce the weight of the bolts of the weapons, an improved bolt design is disclosed and claimed which not only reduces recoil by placing the centerline of the bolt of the weapon closer to the trigger hand of the user than heretofore possible, but also uses the gun barrel as a guiding surface for the bolt.

It is, therefore, one object of this invention to provide a new and improved toggle action weapon whether of the under-center or over-center type in which gas pressure generated in a gun barrel trips the toggle causing it to recede to a retracted position in the handle of the weapon.

Another object of this invention is to provide an improved toggle action weapon in which the center line of its bolt is closer to the trigger hand of the user than heretofore provided in the art.

A further object of this invention is to provide an improved toggle action weapon in which the barrel of the gun controls the movement of the bolt thereby facilitating loading and ejecting of the shells and greatly reducing the possibility of misfiring.

A still further object of this invention is to provide a toggle action weapon employing a new bolt design which eliminates the need for recoil springs positioned longitudinally of the direction of movement of the bolt.

A still further object of this invention is to provide an improved toggle action weapon employing one or more brake means for controlling the recoil action of its bolt mechanism.

A still further object of this invention is to provide an adjustably controlled bolt in a toggle action weapon that is dynamically balanced to accomplish a smooth, consistent and continuous pressure throughout the movement of the bolt after tripping in which the line of force from the moving parts is directed to the palm of the hand, thereby virtually eliminating all noticeable recoil.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawings in which:

FIG. 1 is a partial cross-sectional view of a gas operated toggle action weapon in toggle locked position incorporating the features of this invention;

FIG. 2 is a view similar to FIG. 1 showing the weapon in toggle collapsed position;

FIG. 3 is an end view of FIG. 1;

FIG. 4 is a cross-sectional view of FIG. 1 taken along the line 4—4;

FIG. 5 is a cross-sectional view of FIG. 4 taken along the line 5—5;

DESCRIPTION OF THE PREFERRED EMBODIMENT

Figure 6:
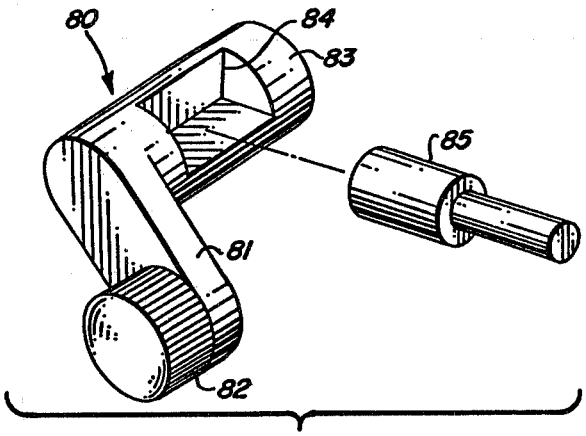
FIG. 6 is an exploded perspective view of a breaking lever and push rod for use with the gun mechanism design shown in FIGS. 1 and 2.

Referring more particularly to the drawing by characters of reference, FIGS. 1 and 2 illustrate an example of one embodiment of this invention illustrating a partial view of a pistol having a frame 25, handle 26, trigger 27 with trigger guard 28 and a bullet magazine 29. A demountable adjustably positioned barrel 30 is received in the semi-circular bore 31 in the front end of frame 25.

The bullet magazine 29 is demountably secured by the usual releasable latch in a guide sleeve 32 of frame 25 to feed the bullets 33 into insertion and firing position by a bolt 34 which moves on a guiding surface 35 in the frame 25 into an aligning tapered aperture 36 in the rear end of barrel 30. The rear end of the bolt 34 is pivotally connected by a pivot pin 37 carried in the front end of a link 38 of a toggle 38–39. The rear end of link 38 is pivotally connected by a pivot pin 40 to the front end of a rear link 39 of the toggle. This rear link in turn is pivotally connected by a pivot pin 41 carried in the rear portion of the frame 25 to thus provide a toggle 38–39 for controlling the movement of bolt 34. Normally, when bullet 33 has been loaded in the barrel in firing position, the toggle 38–39 is aligned, as shown in FIG. 1, at which time the axis of pin 40 is slightly below a line between the axes of pins 37 and 41 so that the toggle 38–39 is in an under-center locked position.

A compression spring 42 carried on a telescoping push rod 43 comprising parts 44 and 45 is slidingly supported in a clearance hole 46 in the handle 26 of the weapon and arranged to have a dome shaped head 44A at the free end of part 44 of rod 43 to bear against the toggle joint. The compression spring 42 operates between the base 47 of opening 46 in handle 26 and the dome 44A of part 44 of the rod 43 to normally yieldingly hold the toggle 38–39 against the knee of the toggle in under-center locked firing position of the gun.

The toggle 38–39 is tripped from under-center locked position by gas pressure from the gun barrel when the gun is fired.

Figure 12:
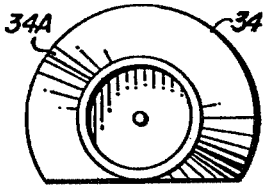
FIG. 12 is a left end view of the bolt shown in FIG. 10.
Figure 10:
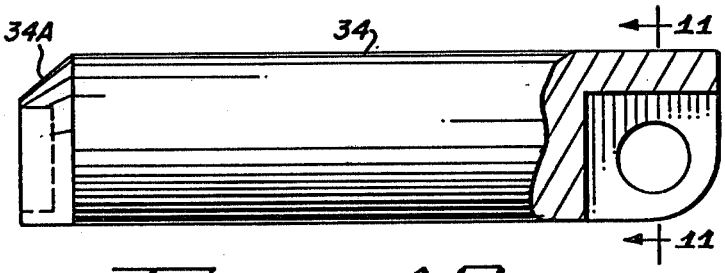
FIG. 10 is a front view partially in elevation of the bolt of the weapon shown in FIGS. 1 and 2.
Figure 11:
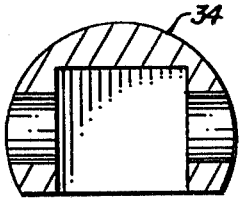
FIG. 11 is a cross-sectional view of FIG. 10 taken along the line 11—11.
Figure 13:
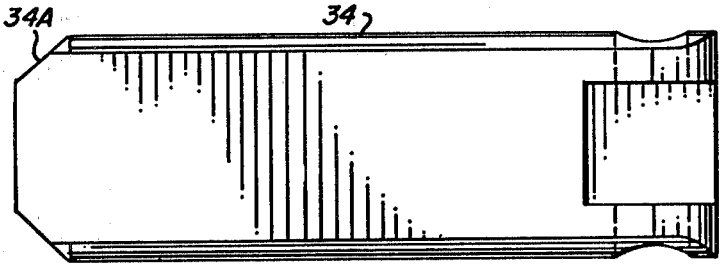
FIG. 13 is a top view of the bolt shown in FIG. 10.
Figure 7:
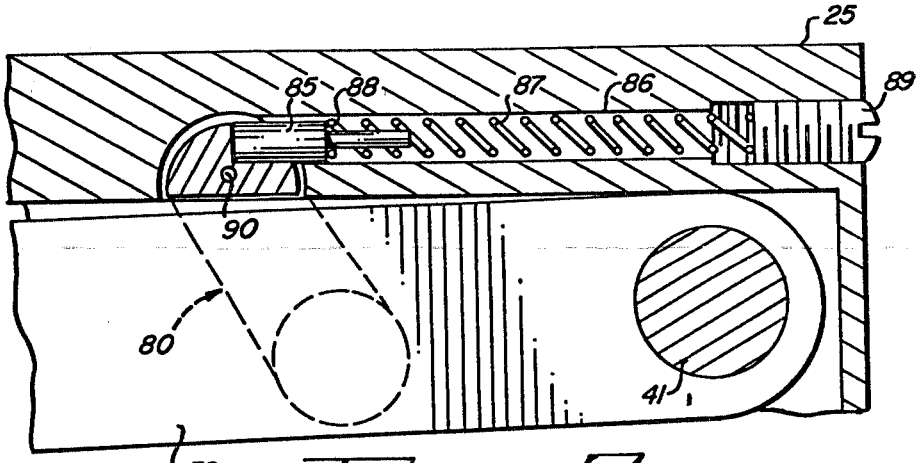
FIG. 7 is a partial view of a modification of the gun mechanism shown in FIGS. 1 and 2 employing the breaking lever and push rod shown in FIG. 6.

As noted from FIGS. 10–13 of the drawing, bolt 34 has been modified to differ from the prior art configurations by providing the normal cylindrical bolt configuration with a flat surface which rests on and is guided by the frame of the weapon. This flat surface arranged along the length of the bolt not only reduces the weight of the bolt, but places the centerline of the bolt and the moving parts of the weapon closer to the trigger hand of the user, thereby reducing primary and secondary recoil of the weapon. FIGS. 10, 12 and 13 further illustrate that the bolt 34 is provided with a cone shaped end 34A which is provided to fit into a corresponding conical shaped opening 36 in the barrel 31 of the weapon. This change facilitates the action of loading and ejecting shells of the bullets into the barrel of the gun thereby increasing its efficiency and reducing the possibilities of misfiring tremendously since the entire barrel of the gun becomes a guiding surface of the bolt thereby eliminating jamming of the weapon.

As shown in the drawings of the prior art, as exemplified by applicant's U.S. Pat. Nos. 3,630,119; 3,661,049; 3,709,091; 3,732,779; 3,748,961 and 3,783,739, compression springs have been arranged between a shoulder formed around a bore, shown in U.S. Pat. No. 3,630,119 defined in a protruding lug of the bolt and a ridge formed in a bore defined by the frame and clamp of the weapon.

At the time the bullet of U.S. Pat. No. 3,630,119 is fired and leaves the barrel and is on its way to its target, residual pressure existing in a chamber of this weapon will drive its bolt backwards with sufficient force to complete the travel of its toggle mechanism sufficient to move the center pin of the toggle and force it to complete its downward travel to its lowest point down inside the handle of the gun against the bias of its compression spring shown in FIG. 2 of this patent.

The inertia of the bolt continues rearwardly compressing the recoil compression spring of this patent until the end of the lug engages a stop surface of the frame of the weapon. The bolt and toggle are returned to their original positions by the stored up energy in its two springs. This completes the firing cycle and prepares the gun for the second firing having picked up an additional bullet from the clip magazine and placed it in the chamber when the bolt returned to its original position by well known conventional mechanism.

Figure 14:
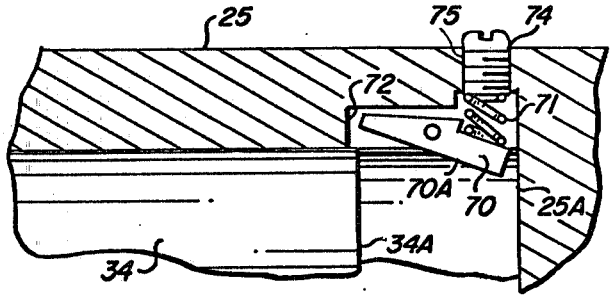
FIG. 14 is a partial view of the weapon shown in FIGS. 1 and 2 illustrating a braking system.
Figure 15:
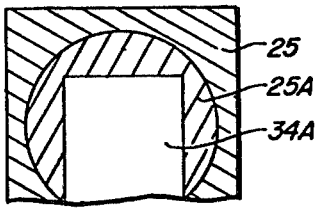
FIG. 15 is an end view of the bolt mechanism shown in FIG. 14 without a braking system.
Figure 21:
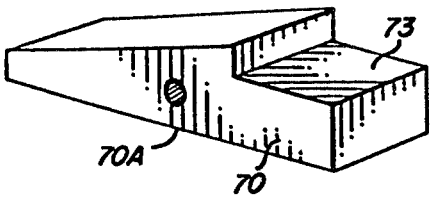
FIG. 21 is a perspective view of the brake shoe shown in FIG. 14.

The mechanism disclosed and claimed herein to serve the function of spring 61 of U.S. Pat. No. 3,630,119 has been eliminated and the braking system shown in FIGS. 14–21 substituted therefor. This braking system as shown in FIGS. 14, 15 and 21 compress a brake shoe 70 pivotally mounted to frame 25 of the weapon and adjustably arranged adjacent edge 25A of frame 25 as shown in FIG. 1 and biased by spring 71 into the path of movement of bolt 34 in frame 25.

Upon collapsing of the toggle 38–39 under the recoil of an exploding bullet the end 34A of the bolt 34 will engage surface 70A of the brake shoe and force it to compress spring 71 as it pivotally moves back into cavity 72 in the bore of the receiver. Since spring 71 extends between a ledge 73 of brake shoe 70 and the end of an adjustment screw 74 threadedly mounted in an aperture 75 in frame 25, a retarding force can be applied to bolt 34 reacting under the explosive force of a bullet without the need of the prior art type of compression springs.

Figure 16:
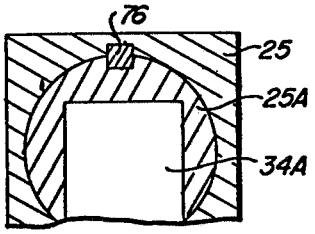
FIG. 16 is a diagrammatic end view similar to FIG. 15 illustrating the use of one braking system.
Figure 18:
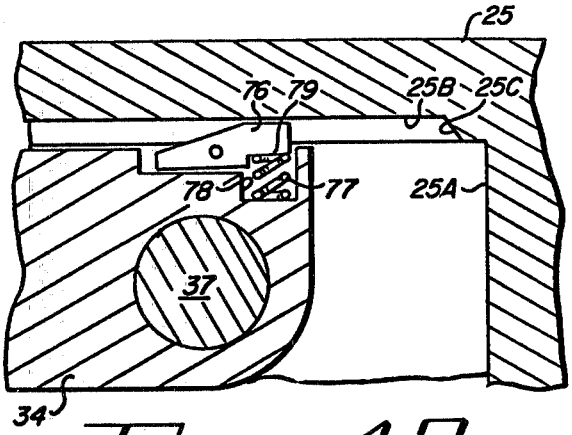
FIG. 18 illustrates a modification of the braking system illustrated in FIG. 14 with the braking system mounted on the bolt and the bolt moving backward under a recoil action.
Figure 19:
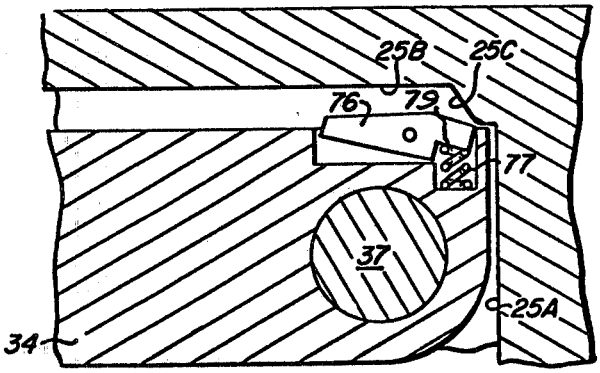
FIG. 19 illustrates the structure shown in FIG. 18 with the bolt in fully retracted position.
Figure 20:
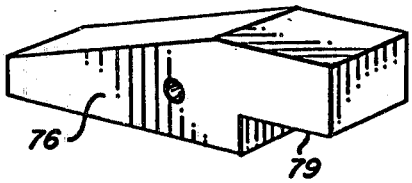
FIG. 20 is a perspective view of the brake shoe shown in FIGS. 18 and 19.

FIGS. 16, 18 and 19 illustrate a further modification of this braking feature wherein the brake shoe 76 is pivotally mounted to bolt 34 in a cavity 78 arranged at its end pivotally connected by pin 37 to toggle 38–39. Shoe 76 is biased to its normal non-braking position shown in FIG. 18 by a spring 77 extending between the base of a cavity 78 in bolt 34 and a ledge 79 in shoe 76. In this modification, the frame 25 is provided with a groove 25B in which one part of the shoe extends and the end 25C of which forms a slope for pivotally actuating the shoe into progressively greater braking action as shown in FIG. 19.

Figure 17:
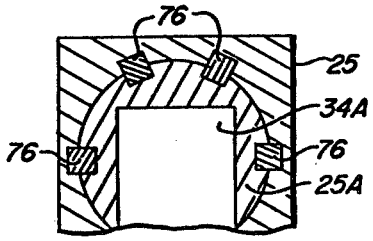
FIG. 17 is a diagrammatic end view similar to FIGS. 15 and 16 illustrating the use of four braking systems.

FIG. 17 shows that more than one braking system may be applied to a single bolt and illustrates shoes 76 positioned to apply braking forces to the bolt during a toggle collapsing action.

In order to trip the toggle 38–39 to lead the first bullet into the gun, a manual lever 80, as shown in FIGS. 6–9, may be provided on the gun shown in FIG. 1 which when rotated by the operator clockwise against the action of a spring 87 contacts the under-center toggle 38–39 causing it to trip far enough to allow the operator to move bolt 34 back sufficiently to permit a bullet 33 from the clip magazine 29 to enter the chamber of the gun for the first firing action.

This manual lever 80 comprises a crank arm 81 having a knurled cylindrical knob 82 extending laterally from one end thereof and a cam arm 83 extending laterally therefrom at its other end in the opposite direction of knob 82. The cam arm is provided with a notch 84 for receiving the end of a push rod 85. The push rod is slidably mounted in a cylindrical cavity 86 formed in the end of frame 25 adjacent pivot pin 41. As noted from FIGS. 7–9, the push rod 85 is biased into engagement with the walls of cavity 84 of cam arm 83 of the manual lever 80 by a spring 87. Spring 87 is positioned between a ledge 88 on the push rod 85 and the end of an adjustment screw 89 threadedly arranged in the end of cavity 86 in frame 25.

Figure 8:
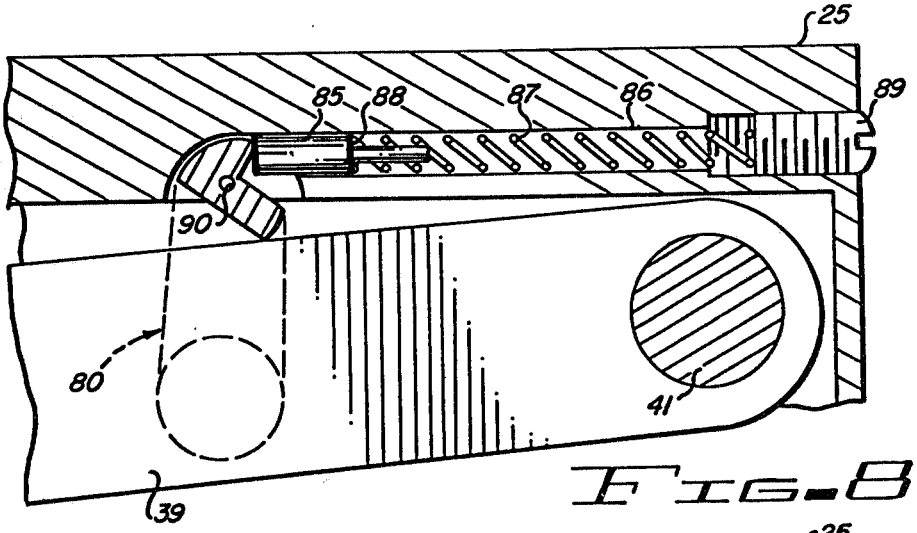
FIG. 8 is a view similar to that shown in FIG. 7 with the breaking lever at an intermediate position during a toggle tripping action.
Figure 9:
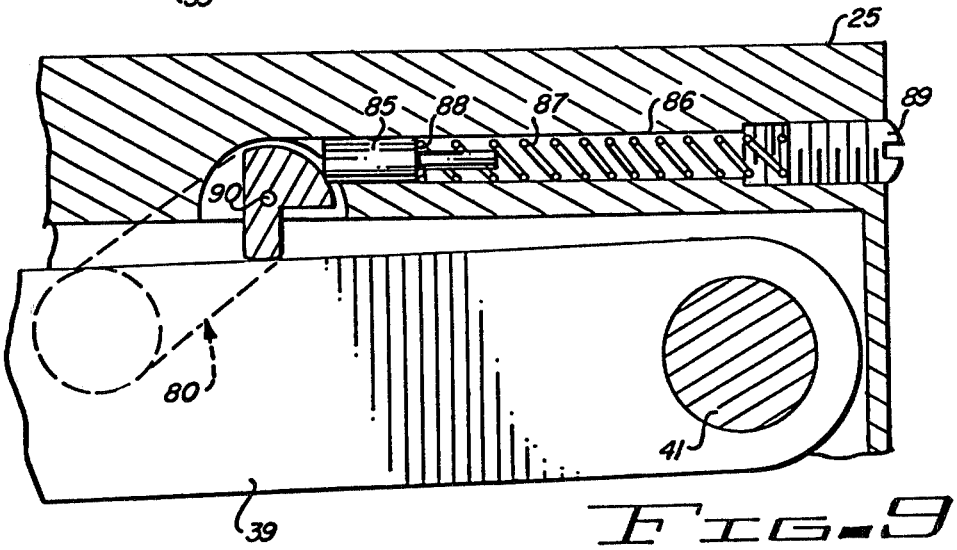
FIG. 9 is a further view similar to FIGS. 7 and 8 illustrating the breaking lever in its fully extended position.

As evident from FIGS. 8 and 9, as lever 80 is pivotally rotated about its pivotal connection 90 to frame 25, cam arm 80 engages toggle arm 39 and, as shown in FIG. 8, allow the weapon to be cocked. Further rotation of the cam arm in the same direction to the position shown in FIG. 9 further breaks the toggle placing the weapon in a safety position making it impossible to straighten the toggle to fire the weapon until the manual lever 80 is returned to its original position shown in FIG. 7.

It should be noted that the disclosed novel gun system or apparatus reduces the distance between trigger hand and the centerline of the bolt of the gun from that used in the prior art structures, employs a cocking lever that also can be used as a safety with a push rod to aid in returning it to its non operative position, and an adjustable braking system that eliminates one or more of the compression springs of the prior art.

Heretofore, springs placed in the weapon to bias the toggle into its extended position had difficulty in placing the toggle and the bullet in the magazine in an identical position each time the weapon was fired. If a spring was positioned in the gun so as to be longitudinally arranged with the bolt of the weapon, the spring was then capable of driving the bullet forward into the chamber of the gun hard enough to seat it properly but it was not in a favorable position for absorbing recoil of the weapon or to aid in positioning the toggle in its properly extended position each and every cycle of gun actuation. Thus, if only a single spring was used longitudinally of the toggle mechanism, the toggle whether it was an under-center or over-center mechanism usually sagged a bit and if there was any friction in the operation of the moving parts, the sag prevented the bullet from being seated identically in the same position each time. Springs mounted to operate on the knee of the toggle arranged transversely to the longitudinal axis of the toggle failed also to seat the bullet each and every time and particularly were not in the most favorable position for absorbing recoil of the exploding shell.

Therefore, it is necessary to modify the bolt as disclosed hereto to operate in conjunction and combination with the toggle to obtain a dynamic balance operating system to absorb the recoil of the exploding shell as well as control the operation of the collapsing and extending of the toggle mechanism.

Heretofore, in weapons of the type disclosed, the toggle mechanism acted as a locking device and when collapsed, the recoil had to be absorbed by the bolt as it struck an abutting surface at the rear of the weapon. The bolt would come to a dead stop at the rear of the weapon thereby transmitting the recoil of the exploding shell to the holder of the weapon. When using high recoil shells, applicant has applied a braking system for the bolt which is effective without adding undesirable weight to the moving recoil control system found necessary in the prior art.

Although but a few embodiments of the invention have been shown and claimed, it will be apparent to those skilled in the art that various changes and modifications may be made therein without departing from the spirit of the invention or from the scope of the appended claims.

What is claimed is:

1. A bolt action weapon comprising:

A frame, a handle on said frame, a hollow barrel having a firing chamber, a bolt movable in said frame axially to and from the firing chamber of said barrel, a toggle connected at one end to said bolt and at the other end to said frame, said toggle comprising a pair of pivotally connected links, the free end of one of said links being pivotally connected to said bolt and the free end of the other of said links being pivotally connected to said frame, said toggle being movable to a locked position when said bolt has been moved to said firing chamber, a compression means for controlling the movement of said toggle as it collapses by causing the intermediate pivot axis to swing downwardly away from said bolt, said compression means comprising a push rod pivotally engageable with said toggle at a point between its ends and slidably mounted for movement transversely of said bolt, and a spring means mounted on said push rod between a fixed flange in said handle and a fixed flange on said push rod for compression of said spring means during movement of said push rod upon collapsing of said toggle, said spring means biasing said toggle to its locked position after a collapsing action of said toggle.

said bolt being cone-shaped at its free end to fit into a corresponding conical shape in the juxtapositioned end of the firing chamber in said barrel, a breaking lever for biasing said toggle to one of a number of positions, said lever comprising a spring biased plunger mounted in an opening arranged in said frame coaxially of its longitudinal axis, a cam arm engageable by said plunger, and a lever arm extending laterally of said frame for movement of said cam arm by a user into engagement with said toggle for biasing and holding said toggle in one of a number of positions.

2. The bolt action weapon set forth in claim 1 wherein:

said frame defines a flat track on which said bolt is axially movable to and from said firing chamber, and said bolt comprises a cylindrical configuration, a part of the periphery being flattened to provide a surface along its length for engaging said track for movement therealong.

3. The bolt action weapon set forth in claim 2 in further combination with:

a brake shoe mounted on said frame and biased within the path of movement of said bolt for engaging and retarding the movement of said bolt before it reaches the end of its travel in a toggle collapsing action.

4. The bolt action weapon set forth in claim 3 in further combination with:

means for selectively biasing said brake shoe.

5. The bolt action weapon set forth in claim 1 in further combination with:

a brake shoe mounted on said bolt and biased for engagement with said frame at a given point along its path of movement.

6. The bolt action weapon set forth in claim 3 wherein:

a plurality of brake shoes are spacedly positioned on said frame around the path of movement of said bolt, said brake shoes being biased into engagement with said bolt at a point along the path of movement of said bolt.

7. The bolt action weapon set forth in claim 1 in further combination with:

means for adjustably controlling the spring bias of said plunger.

* * * * *